United States Patent [19]

Sumner

[11] 4,092,810

[45] June 6, 1978

[54] DOMICAL STRUCTURE

[76] Inventor: John S. Sumner, 728 N. Sawtelle, Tucson, Ariz. 85716

[21] Appl. No.: 778,032

[22] Filed: Mar. 16, 1977

[51] Int. Cl.[2] ..... E04B 1/32

[52] U.S. Cl. ..... 52/81; 52/748

[58] Field of Search ..... 52/80, 81, DIG. 10, 52/83, 748

[56] References Cited

U.S. PATENT DOCUMENTS

| | | | |
|---|---|---|---|
| 2,736,072 | 2/1956 | Woods | 52/81 |
| 2,905,113 | 9/1959 | Fuller | 52/81 |
| 2,978,074 | 4/1961 | Schmidt | 52/81 |
| 3,296,755 | 1/1967 | Chisholm | 52/81 |
| 3,562,976 | 2/1971 | Wollin | 52/81 |

FOREIGN PATENT DOCUMENTS

| | | | |
|---|---|---|---|
| 1,255,636 | 12/1971 | United Kingdom | 52/81 |

*Primary Examiner*—Ernest R. Purser
*Assistant Examiner*—Henry Raduazo
*Attorney, Agent, or Firm*—Warren F. B. Lindsley

[57] ABSTRACT

This improved domical structure is constructed of scalene triangular panels secured together along great circle arcs formed by the overlapping edges of the panels. Because of the reinforcing action of the great circle panel overlap, the structure requires no supporting framework.

2 Claims, 19 Drawing Figures

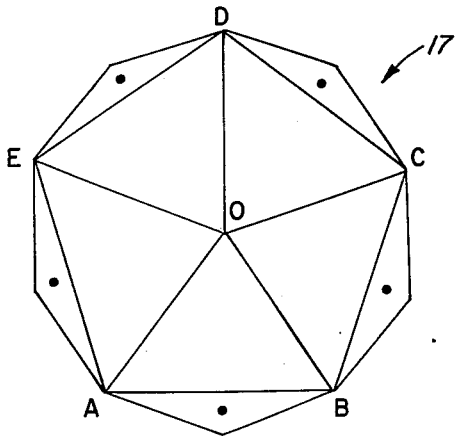
FIG. 7
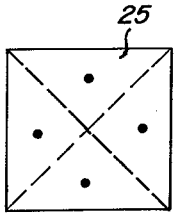
FIG. 11A
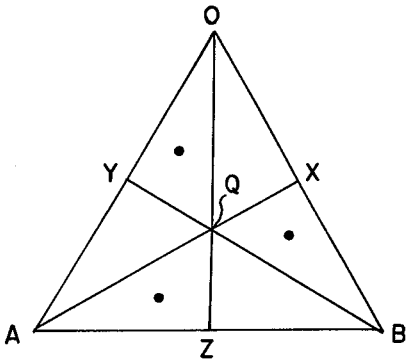
FIG. 8
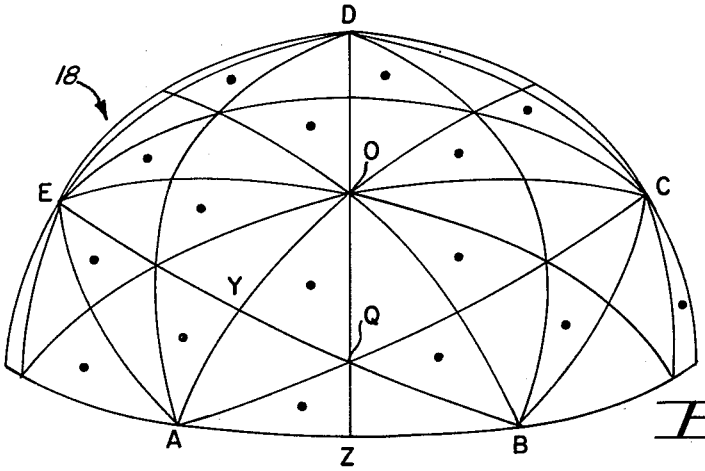
FIG. 9
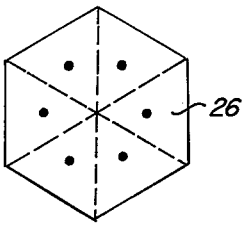
FIG. 11B
FIG. 11C
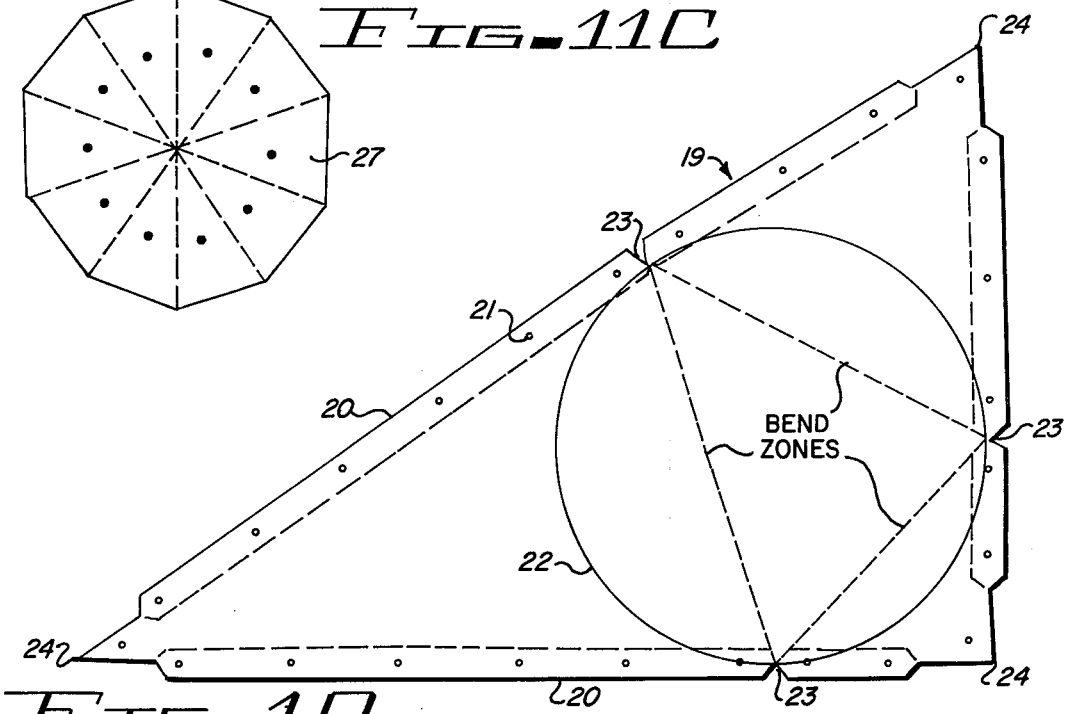
FIG. 10

DOMICAL STRUCTURE

BACKGROUND OF THE INVENTION

It is well known that domical buildings are more efficient than conventional rectangular structures and enclose a greater volume of space for the same amount of material used. Domes also have the highest strength per unit of weight of any man-made structure. In addition, they are the most stable building enclosure devised, since force applied at any point is resisted more uniformly throughout the structure.

However, domical structures have not gained wide acceptance in spite of these important advantages. One of the reasons for this lack of acceptance is the difficulty encountered in fabricating and erecting such a structure. Most domical structures have complicated joint connections which are not easily assembled in the field, and the beam members have been difficult to form and install. In addition, the efficient use of covering materials has been complicated by the spherical surfaces which are more difficult to lay out than are the rectangular shapes characteristic of normally available building materials.

DESCRIPTION OF THE PRIOR ART

Considerable attention has been given to innovations that would hopefully lead to the surmounting of these difficulties.

G. B. Woods (U.S. Pat. No. 2,736,072) proposed the division of the hemisphere into triangular quadrants and each quadrant into three four-sided spherical figures, the latter division being accomplished by drawing lines from the midpoint of the quadrant to the midpoint of each of its three sides. The resulting dividing lines lie along great circle arcs and define the supporting framework. Woods then goes on to describe a method for covering the four-sided spherical area using originally flat sheathing material, the method relying upon the subdivision of the area so as to obtain a flat diamond-shaped central area surrounded by four curved isosceles triangles over which a flat sheathing material could be laid and fitted to follow the curvature of the supporting beams.

R. B. Fuller (U.S. Pat. No. 2,905,113) describes a self-strutted geodesic structure in which overlapping rectangular panels are joined along the outlines of a grid of geodesic triangles. The triangles are isosceles, again with the apparent purpose of facilitating the forming of the corners of the panels to the spherical domical surface. Surface coverage is incomplete and the structure has not met with acceptance.

In a later patent (U.S. Pat. No. 3,197,927), Fuller defines sets of pre-formed and pre-shaped elements that may be assembled on the site into geodesic structures.

C. J. Schmidt (U.S. Pat. No. 2,978,074) subdivides a spherical surface by a framework of curved triangles in order to facilitate the covering of the structure with flat sheating materials. In this case a spherical pentagon is subdivided by lines from the center to the five corners. These lines define the framework of isosceles triangles which can then be fitted by inserting flat triangular panels. The covering material lies flat over the center of a triangle and follows the curvature of the supporting structure over the edges.

FIELD OF THE INVENTION

The present invention eliminates the supporting structure entirely and subdivides the spherical surface into scalene triangles. The total frameless structure utilizes a single triangular element in left-hand and right-hand configurations. Two such elements may be readily cut from a single sheet of plywood of standard dimensions with a minimum of waste. The elements or panels overlap at the edges where they are secured together to form great circle arcs, the overlapping edges composing in themselves an integral reinforcing supporting structure. The present invention addresses for the first time the covering of spherical scalene triangular openings with initially flat sheathing materials and realizes the inherent advantages they provide as basic elements of domical structures.

SUMMARY OF THE INVENTION

In accordance with the invention claimed, an improved domical structure is provided that utilizes as its basic building block a triangular panel by mating right-hand and left-hand versions. The triangular panels are secured at their overlapping edges to form an integral reinforcing structure which requires no supporting framework.

It is, therefore, one object of this invention to provide an improved domical structure.

Another object of this invention is to provide a domical structure that requires no supporting framework.

A further object of this invention is to provide a domical structure in which the need for the supporting framework is obviated by the utilization of overlapping scalene triangles, their overlapping joined edges forming along great circle arcs an integral reinforcing structure.

A still further object of this invention is to provide such an improved domical structure in which the use of the scalene triangular panels permits a high degree of material efficiency.

A still further object of this invention is the achievement through the use of the scalene triangular pattern a significant improvement over the prior art in terms of conformity to the true spherical surface.

Yet another object of this invention is to provide a means for forming the outlines of the spherical scalene triangles from initially flat sheathing material.

These and other objects and advantages of the present invention will become apparent as the following description proceeds and the features of novelty that characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 7 is an axial view of an icosahedron from which the design of the domical structure of the invention is derived;

FIG. 8 is an illustration of the subdivision of a face of the icosahedron of FIG. 7 into six scalene triangles;

FIG. 9 is a perspective view of the domical structure of the invention as assembled from scalene spherical triangular panels, the designs of which were derived from constructions based on the configurations of FIGS. 7 and 8;

FIG. 10 is an illustration of a triangular panel utilized as the basic building block for the construction of the domical structure of FIG. 9;

FIGS. 11A, 11B and 11C are illustrations of a set of corner hubs for optional use in the construction of the domical structure of the invention;

DESCRIPTION OF THE PREFERRED EMBODIMENT

Figure 1:
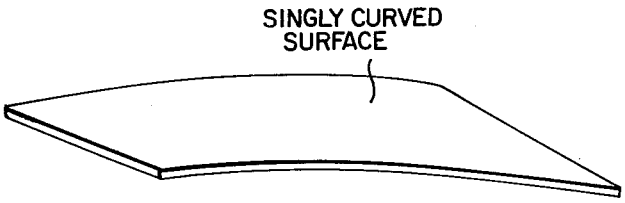
FIG. 1 is an illustration of a singly curved surface.
Figure 2:
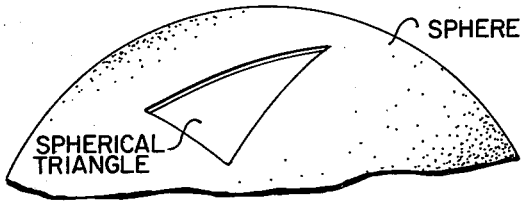
FIG. 2 is an illustration of a spherical triangular opening in a spherical surface.

Referring more particularly to the drawing by characters of reference, FIGS. 1–6 illustrate the geometrical principles that form the basis for the domical structure of the invention.

Of primary importance and significance in the construction of an efficient and structurally sound domical structure is the curved triangular configuration of the basic element, or panel, employed to cover the spherical surface. The configuration of the panel is important in terms of its ability to conform to the spherical surface and in terms of its efficient utilization of standard building materials. Of equal importance is its compatibility with the principles affecting the mechanical strength of the completed structure.

Because the present invention utilizes a scalene spherical triangle as a basic building block, a review of the principles involving plane and spherical surfaces and of the geometry involved in spherical triangle construction is an appropriate introduction. In this connection, the following definitions should be kept in mind:

A spherical triangle is one whose sides are formed of arcs of great circles. A great circle of a sphere is formed by the intersection of a plane which passes through the sphere's center. A small circle is any other plane intersection with the sphere.

A singly curved surface is a surface that originally may have been flat. The curvature of a flat surface with respect to a point on the surface is zero in both X and Y directions; that is, the radii of curvature are infinite since:

$$\text{curvature} = (1/\text{radius of curvature}).$$

Figure 3:
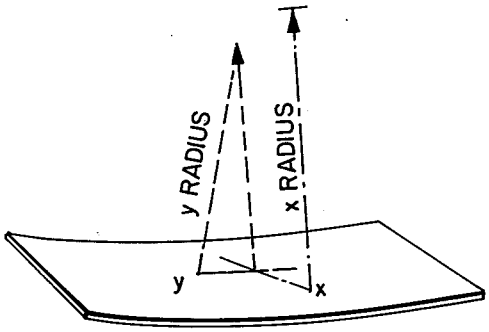
FIG. 3 is a further illustration of a singly curved surface.

A singly curved surface, viewed at a point on the surface, has zero curvature (infinite radius of curvature) in one direction and some finite curvature value in the direction at right angles as shown in FIG. 3.

Figure 4:
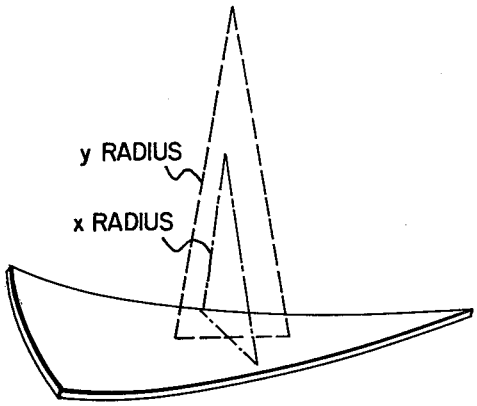
FIG. 4 is an illustration of a doubly curved surface.

A doubly curved surface, viewed at a point on the surface, has a finite curvature value in both directions, as shown in FIG. 4. A spherical surface has equal curvatures, both of the same sign, in any two directions. An originally flat surface cannot be transformed into a doubly curved surface by simple bending, using the concepts of Euclidean geometry.

Figure 5:
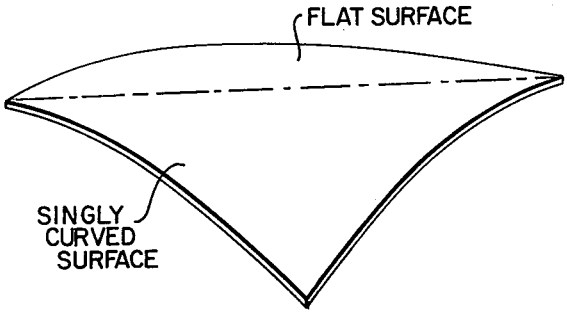
FIG. 5 is an illustration of a spherical triangle covered by a folded, singly curved surface.

It should be noted that all spherical triangles (equilateral, isosceles, and scalene) can be covered by singly curved surfaces using any of a variety of covering methods. Not all of the available methods are acceptable, however, because the originally flat surface may have to be folded to accomplish the covering. For example, a spherical triangle may be covered with a flat surface extending completely across two sides and the included angle and the third edge would be covered by the great circle plane extending to the first covering surface, intersecting along a straight fold line as shown in FIG. 5. This covering method would accomplish the basic objective, but the close folding would be structurally unacceptable.

Any joints between standard-sized panel segments of the dome's shell surface must be as strongly bonded and as rigid as the shell itself or the joint becomes a zone of weakness and possible eventual buckling. Of course, the major joints are between the spherical triangle sections where adjoining curved surface sectors abut.

Figure 6:
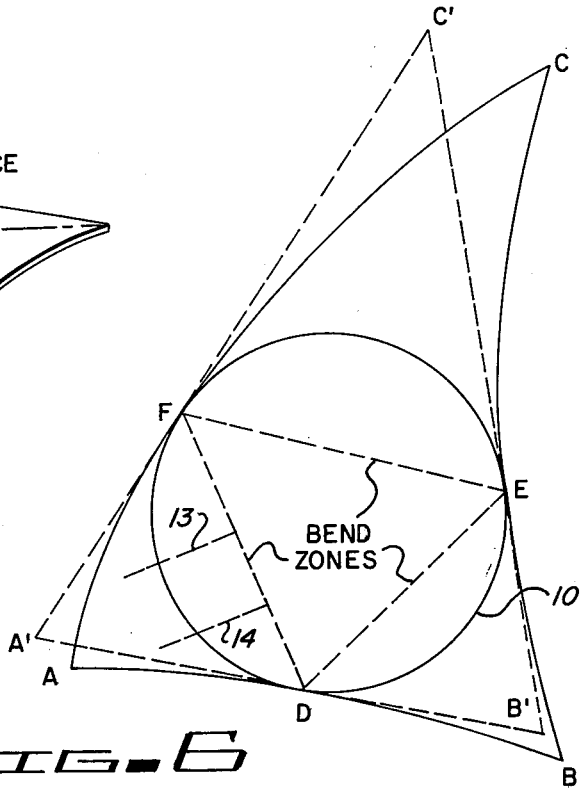
FIG. 6 is an illustration of a spherical triangle with construction lines detailing a method for covering spherical triangular openings in spherical surfaces.

The method for laying out the pattern in the application of spherical triangles to domical surface structures is illustrated in FIG. 6. A circle 10 is first inscribed in the spherical triangle ABC. The center of the circle may be found at the intersection of the bisectors of the three angles of the triangle. The circle 10 is tangent with the sides of triangle ABC at points D, E and F. Lines joining points D, E and F form an inscribed triangle DEF.

By definition, the sides of triangle ABC are arcs of great circles of the spherical surface of which the triangle ABC is a part. The triangle ABC may be equilateral, isosceles, or scalene. For all such variations the construction of the foregoing paragraph applies as does the application that follows.

In the illustration of FIG. 6, the sides of the inscribed triangle DEF define three bend zones as indicated. The bend zones are lines of demarcation between the flat surface inside triangle DEF and curved surfaces outside triangle DEF that are formed in shaping a triangular panel to cover a spherical triangular opening ABC.

Thus, if a flat triangular panel A'B'C' is placed over the spherical triangular opening ABC, contact will first be made at the three points of tangency, D, E and F. The triangular extension FC'E is then bent downward beginning along line FE and progressing outwardly until the segments FC' and EC' of the panel conform to the arcuate edge surfaces FC and ED of the spherical triangular opening. In the same manner, triangular extensions FA'D and EB'D are bent downward beginning along lines FD and ED, respectively, until conformity is achieved with edges FA and AD and EB and BD of the spherical opening ABC.

The sub triangle FDA will be an equilateral or an isosceles triangle and the portion of the formed panel A'B'C' in the area FDA' will have a singly curved surface, i.e. perpendicular cross sections taken along lines 13 and 14, which are mutually perpendicular to line FD, will conform to the same elliptical curve.

In reality an originally flat, triangular panel will not of its own accord form a creased fold exactly on the aforementioned bend lines DE, EF, and FD, but rather the bending will actually take place in a gradual transition zone between the singly curved surface in the corner triangle and the flat surface in the interior triangle. Nevertheless, for layout computational purposes the difference between an exact bend line and a more gradual bend zone is very small.

Approaching more closely the development of the domical structure of the invention, attention is now called to the icosahedron 17 of FIG. 7. An icosahedron is a 20-sided figure in which each of the 20 faces is an equilateral triangle and the apexes of the triangles are common to a single circumscribed spherical surface. About any single apex of the icosahedron a pentagonal pyramid is formed as, for example, the pyramid ABCDEO of FIG. 7.

Beginning with the icosahedron 17, the domical structure 18 of FIG. 9 will now be derived.

The first step in this derivation is the formation of six scalene triangles within each of the equilateral triangular faces of icosahedron 17. The formation of the six scalene triangles is illustrated in FIG. 8 for triangle ABO, the location of which is also identified in FIG. 7. To form the scalene triangles, bisectors AX, BY and OZ, respectively, of angles OAB, ABO and BOA are drawn as shown. The bisectors AX, BY and OZ intersect at a common point Q to form the six triangles AQY, YQO, OQX, XQB, BQZ and ZQA. Because triangle OAB is an equilateral triangle, the triangles ZAQ, XQB and YQO are identical and are mirror images of the other three scalene triangles.

The six scalene triangles are now inscribed on each of the triangular surfaces of the icosohedron 17 and projected radially to the surface of the sphere defined by the apexes of the icosahedron. The resulting pattern created on the surface of one-half the sphere is shown as the hemispherical domical structure 18 of FIG. 9. Correspondence between the elements of structure 18 and the derivative triangles of FIGS. 7 and 8 is indicated by the common alphabetical characters of reference.

Already apparent in the configuration of structure 18 are certain features that are highly desirable in terms of achieving the stated objects of the invention. First, a high degree of standardization has been achieved in the sense that only a single triangular panel shape and its mirror image are required to cover the entire surface. Second, the configuration lends itself well to the purpose of achieving a mechanically sound structure by virtue of the fact that all the joints between panels lie along great circles of the spherical surface. Third, the scalene triangle contains one right angle and the length of the shorter side is roughly half the length of the longer side so that two of the panels may be conveniently cut from a single rectangular sheet of plywood or other sheathing material with a minimum of waste.

Finally, the symmetry of the design and the gracefully curved sectors or panels offer interesting possibilities for architectural aggrandizement in the final rendering of the physical structure.

The important step in the development of the domical structure of this invention is the definition of a basic building block in the form of a triangular panel which may be utilized in the assembly of structure 18. In accordance with the stated objects of the invention, such a panel must obviate the need for a framework of supportive structure.

Shown in FIG. 10 is the pattern of a scalene triangular panel 19 which has been suitably equipped with means for interconnections as required in the assembly of the total structure. The general outlines of panel 19 are in close conformity with the scalene spherical triangle AZQ, BXQ or OYQ of FIG. 8, and those of its mirror image conform equally well to the triangles BZQ, AYQ and OXQ. Along each of the three edges interconnection tabs 20 are provided. When adjacent panels 19 are assembled together the tabs 20 of the two panels overlap as the corresponding pre-drilled holes 21 are aligned. As each mating pair of the holes 21 are aligned, a bolt is passed through and secured with a nut and washers.

Inscribed in the illustration of the triangular panel 19 is a circle 22 and the resulting bend zones are shown in accordance with the derivation described earlier. At the corners of the triangle defined by the three bend zones, tabs 20 are notched at 23 to accommodate the transition between the flat area lying inside the bend zones and the curved areas lying outside the bend zones.

In the assembly of panels 19, connections are first made at the holes adjacent notches 23 and then progressing outwardly toward corners 24, placing bolts in each successive hole 21. To align the mating holes at each point of this progression, the triangularly extending corners of panel 19 are drawn into the necessary degree of curvature that causes the holes to be aligned. As the assembly progressess in this manner, the intended spherical contour is automatically achieved.

The assembly may begin at the ground course and progress upwardly in the ordinary manner of construction, or it may begin with the top panels of the dome and progress downwardly, utilizing a vertical pole at the center for support during the assembly operation. In the latter method, a winch may be employed to raise the developing structure as the lower courses are added. The strength of the overlapping joints may be augmented by the application of glue or cement between the overlapping surfaces.

The overlapping edges of the adjacent panels, especially when glued or cemented together, comprise in the completed structure a system of integral reinforcing beams arranged along the arcs of great circles of the domical structure. This ideal arrangement produces a structure of exceptionally great mechanical strength achieved at a very low material cost.

It may be found desirable in some applications of the invention to employ in addition to panels 19 a special set of hubs for securing the corners of the panels. A set of such hubs is illustrated in FIGS. 11A–11C.

FIG. 11A discloses a square hub 25 for use at the convergence of the right-angle corners as at point Y in FIG. 9. FIG. 11B discloses a hexagonal hub 26 for use at the convergence of the 60° corners as at point Q in FIG. 9. FIG. 11C discloses a ten-sided hub 27 for use at the convergence of the 36° corners as at point O in FIG. 9.

The hubs may be stamped from metal at very low cost and will provide additional strength and reinforcement at these critical points where it is inconvenient to overlap the joints of the panels.

A further advantage of the domical structure of the invention is its close conformity to the true spherical surface. This is achieved by virtue of the high ratio of curved surface area to flat surface area as may be visualized by comparing the curved areas of panel 19, i.e., the areas outside the inscribed triangle with the flat area inside the inscribed triangle. It will also be noted that each of panels 19 is divided into four areas, three of which are curved. The result is a very considerable improvement in the degree of conformity to a spherical surface as compared with Fuller's geodesic surfaces in which a spherical surface is approximated by a series of flat facets.

In a practical illustration of the utility of the domical structure provided in the present invention, a hemisphere having a diameter of 22 feet may be assembled from 60 panels cut from 30 sheets of plywood, each of which is a standard 4 × 8 foot sheet. Exterior grade plywood ⅜ inches thick is suitable for this type of dome. Plexiglas panels also may be employed to build a completely transparent structure, or they may be employed at appropriate locations in a plywood structure for service as windows. Plywood domes such as these are useful for many purposes, such as shelter, storage, etc. The exterior surface may be covered with urethane or with special formulations of gunnite. Plexiglas structures may be utilized as greenhouses, pool covers, etc.

The panels 19 for standard sizes of such domical structures can readily be mass produced at low cost, or they may be fabricated on the site by the "do-it-yourself" builder. In a commercial operation, the panels could conveniently be fabricated by a plywood manufacturer, and they could be preformed to the desired curved and flat surfaces during curing. Such pre-forming of the panels would facilitate and simplify the assembly operation at the building site.

Figure 12:
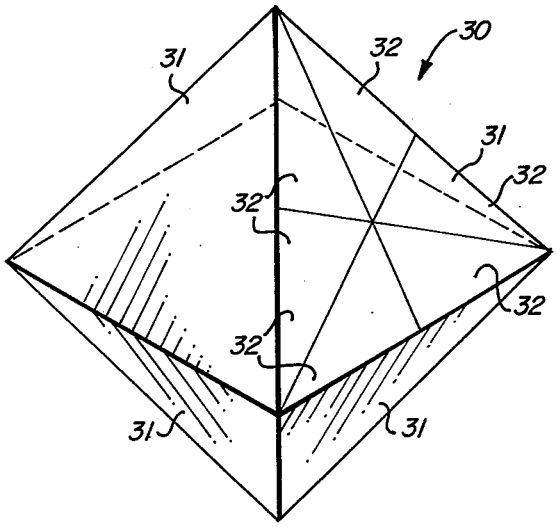
FIG. 12 is an illustration of an octahedron from which an alternate design of the domical structure of the invention is derived.
Figure 13:
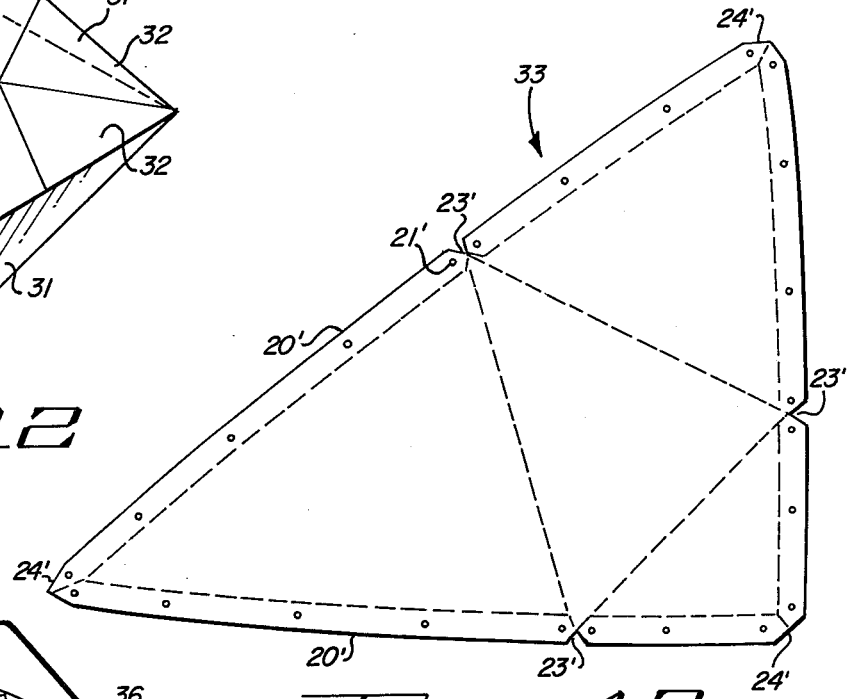
FIG. 13 is an illustration of a curved triangular panel of the shape necessary for the octahedral-derived form of FIG. 12.

A variation of the plane triangular pattern from that derived from an icosahedron shape shown in FIG. 12 is illustrated in FIG. 13. The octahedron 30 seen in perspective in FIG. 12 can have its faces 31 subdivided into six triangles 32, as illustrated for the icosahedron in FIG. 8, then the edges of all of these triangles are projected to a circumscribed spherical surface as was done for the icosahedron. The curved triangular panel 33 of FIG. 13 is similar to the panel of FIG. 10 with similar parts identified with the prime of the reference characters used in FIG. 10, except that for this particular layout no corner hubs, such as shown in FIGS. 11A, 11B and 11C, would be required.

Figure 14:
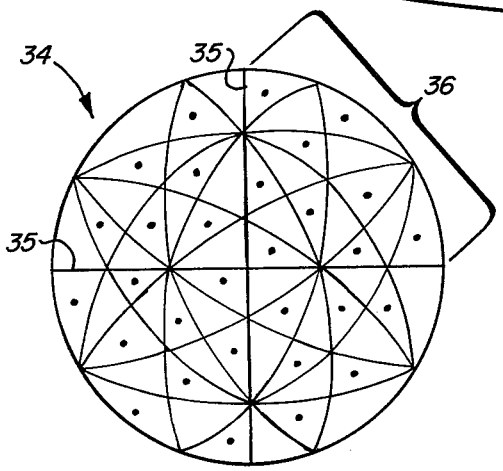
FIG. 14 is a slightly distorted plan view of an icosahedron dome showing the relationship between the overlapping triangular panels.
Figure 15A:
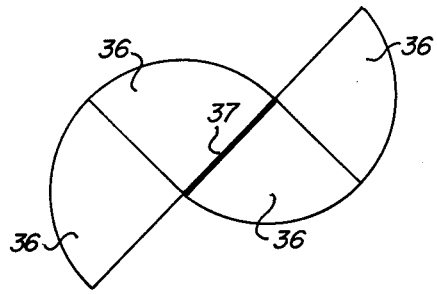
FIGS. 15A, 15B and 15C are plan views of the icosahedron dome showing the hemispherical structure in quarters each sharing a common supportive vertical wall between assembled quarters.
Figure 15B:
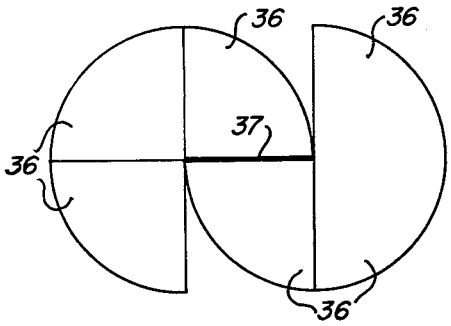
Figure 15C:
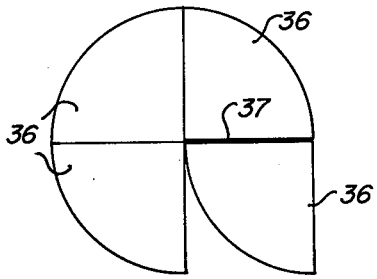

Referring to the plan view of the icosahedron dome 34 in FIG. 14, attention is directed to the vertical intersecting great circle arcs 35 that divide the hemispherical structure into quarters 36. In view of this fact, it is convenient to assemble the structure in quarters, and if a supportive vertical wall 37 is necessary, then it can readily be placed under this boundary. This vertical straight wall 37 could also be made an exterior wall containing windows and doors. The vertical wall can also be a common wall between adjoining domical structures that are each ¼, ½ or ⅜ of the area of a complete dome. This procedure would allow partial domes to be clustered in groups.

It will now be recognized that a significantly improved domical structure is provided over the prior art in accordance with the stated objects of the invention, and while but a few embodiments of the invention have been illustrated and described, it will be apparent to those skilled in the art that various changes and modifications may be made therein without departing from the spirit of the invention or from the scope of the appended claims.

What is claimed is:

1. A roof for a domical structure comprising:

a plurality of scalene triangular panels, interconnected along their peripheries to form a domically shaped roof, each of said panels comprising three curved triangles formed in the corners of each curved triangular sector and interconnected by an interior plane triangle and bent in different directions along the interconnection of each curved triangle with the plane triangle to form a plurality of singly curved surfaces, each of said panels positioned adjacent to the edge of an adjoining panel to form a mirror image of the other and comprising a pair, each panel of each pair being interconnected with its mirror image of another panel of a juxtapositioned pair of said panels, and the interconnection between adjacent panels lying substantially along arcs of great circles of the domical structure and forming the framework of the structure, said panels overlapping to form said interconnection between adjacent panels, said roof comprising a structure formed only from edge to edge connected planar panels, and being free of other supporting framework.

2. A method of forming a roof for a spherical structure from a plurality of scalene spherical triangular panels the sides of which form arcs of great circles comprising the steps of:

forming a plurality of pairs of originally flat plane triangular surfaces each pair having substantially the same area, bending said plane triangular surfaces along bend lines formed by bases of curved triangles one formed in each of the corners of said triangular surfaces to form a plurality of singly curved surfaces surrounding an interior plane triangle, said bends forming the sides of said interior plane triangle and being sufficient to cause the edges of each of said curved surfaces to substantially conform to a scalene spherical triangular panel, and overlapping edges of adjacent panels to form parallel great circle arcs, connecting each panel of each pair with the mirror image of a juxtapositioned pair of said panels along arcs of great circles of the spherical structure, thereby forming the framework of the spherical structure by said interconnection.

* * * * *